US007131229B1

(12) United States Patent
Davis

(10) Patent No.: US 7,131,229 B1
(45) Date of Patent: Nov. 7, 2006

(54) PORTABLE TUBE CLEANING SYSTEM

(75) Inventor: Terry L. Davis, Yuma, AZ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 11/407,819

(22) Filed: Apr. 21, 2006

Related U.S. Application Data

(62) Division of application No. 10/655,072, filed on Sep. 5, 2003, now Pat. No. 7,055,278.

(51) Int. Cl.
*F41A 29/02* (2006.01)

(52) U.S. Cl. ..... 42/95; 15/104.16

(58) Field of Classification Search ..... 42/95; 15/104.16
See application file for complete search history.

(56) References Cited

U.S. PATENT DOCUMENTS

| | | | | |
|---|---|---|---|---|
| 3,708,820 | A * | 1/1973 | Schultea | 15/104.16 |
| 4,369,071 | A * | 1/1983 | Flach et al. | 134/8 |
| 4,503,578 | A * | 3/1985 | McIntyre | 15/104.165 |
| 5,171,925 | A | 12/1992 | Mekler | |
| 5,826,298 | A * | 10/1998 | Rohrbacher et al. | 15/321 |
| 6,464,010 | B1 * | 10/2002 | Brown | 166/311 |

* cited by examiner

*Primary Examiner*—Troy Chambers
(74) *Attorney, Agent, or Firm*—Alan P. Klein

(57) ABSTRACT

A portable cannon tube cleaning method comprising the steps of pulling a trailer to the site of a cannon tube to be cleaned, adjusting the height of a main cleaner chassis assembly to be in line with the cannon tube to be cleaned, fitting the main cleaner chassis assembly against a face of the cannon tube, fitting a hollow adapter plate on the outer diameter of the cannon tube, and hauling a cleaning brush assembly through the cannon tube for as many cycles as required to adequately clean the tube for inspections.

4 Claims, 2 Drawing Sheets

PORTABLE TUBE CLEANING SYSTEM

CROSS REFERENCE TO RELATED APPLICATIONS

This application is a Division of application Ser. No. 10/655,072, now U.S. Pat. No. 7,055,278, filed Sep. 5, 2003.

BACKGROUND OF THE INVENTION

This invention relates generally to firearms, and more particularly to implements for barrel cleaning.

Accurate visual inspections and physical measurements are required to ensure that cannon tubes used in the field for the live testing of munitions are safe for repeated use. Residue left in the tubes by the munitions can interfere with the inspections and measurements. This residue must be removed first. In the past, the residue was removed manually. The process was time consuming and labor intensive. This generally yielded unacceptable results, requiring that the cleaning process be repeated.

SUMMARY OF THE INVENTION

It is therefore an object of this invention to clean cannon tubes in the field so that they are clean enough for required inspections.

This and other objects of the invention are achieved by a portable cannon tube cleaning method comprising the steps of pulling a trailer to the site of a cannon tube to be cleaned, adjusting the height of a main cleaner chassis assembly to be in line with the cannon tube to be cleaned, fitting the main cleaner chassis assembly against a face of the cannon tube, fitting a hollow adapter plate on the outer diameter of the cannon tube, and hauling a cleaning brush assembly through the cannon tube for as many cycles as required to adequately clean the tube for inspections.

Additional advantages and features will become apparent as the subject invention becomes better understood by reference to the following detailed description when considered in connection with the accompanying drawings wherein:

DETAILED DESCRIPTION

Figure 1:
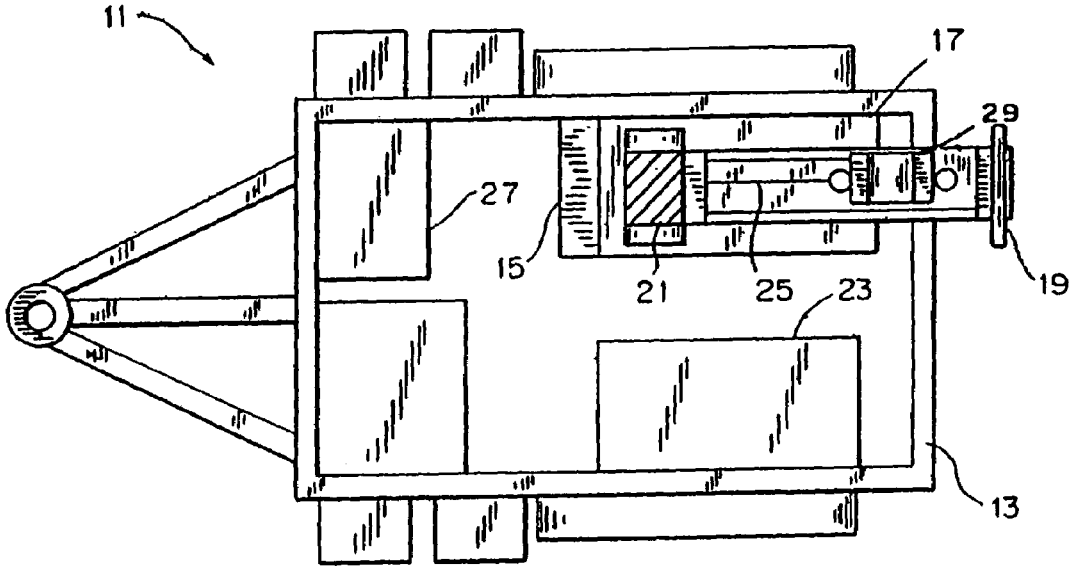
FIG. 1 is a top view of a portable cannon tube cleaning system in accordance with the invention.
Figure 2:
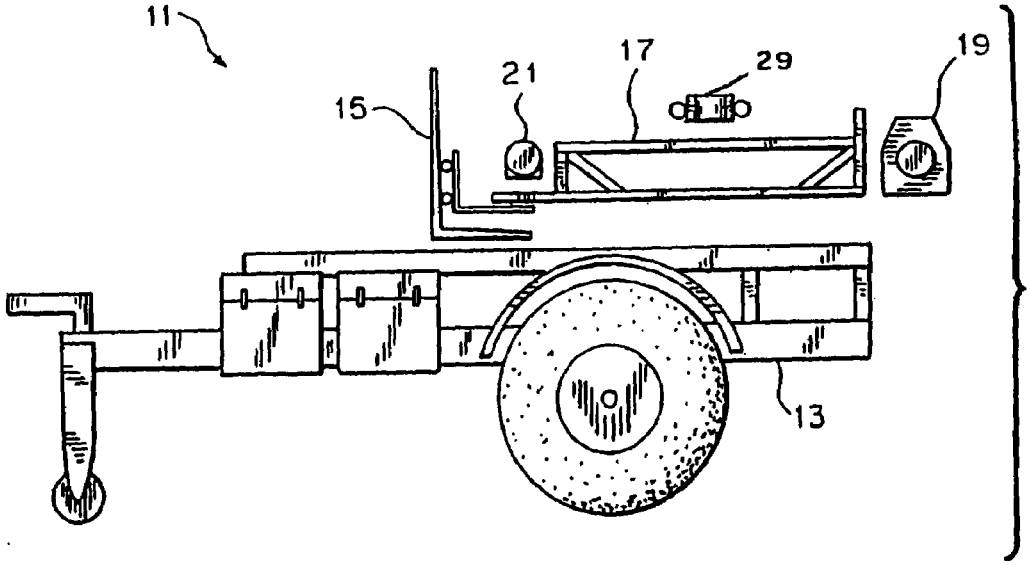
FIG. 2 is an exploded side view of a portable cannon tube cleaning system in accordance with the invention.

Referring to FIGS. 1 and 2, the portable cannon tube cleaning system 11 includes a trailer 13, an automatic or manually-operated lifting platform 15 having its base securely mounted to the floor of the trailer, and a main cleaner chassis assembly 17 securely mounted to the lifting platform. The main cleaner chassis assembly 17 has an end that is adapted to fit against the face of the cannon tube to be cleaned (not shown) and which accommodates a hollow adapter plate 19 selected to fit on the outer diameter of the cannon tube. The main chassis assembly 17 contains an electric, hydraulic, or an air winch 21, and a winch cable 25 connected to the winch. The winch is controlled by an on-board winch controller 23. The system may derive its power from either an on-board generator 27 or an external generator (not shown).

Figure 3:
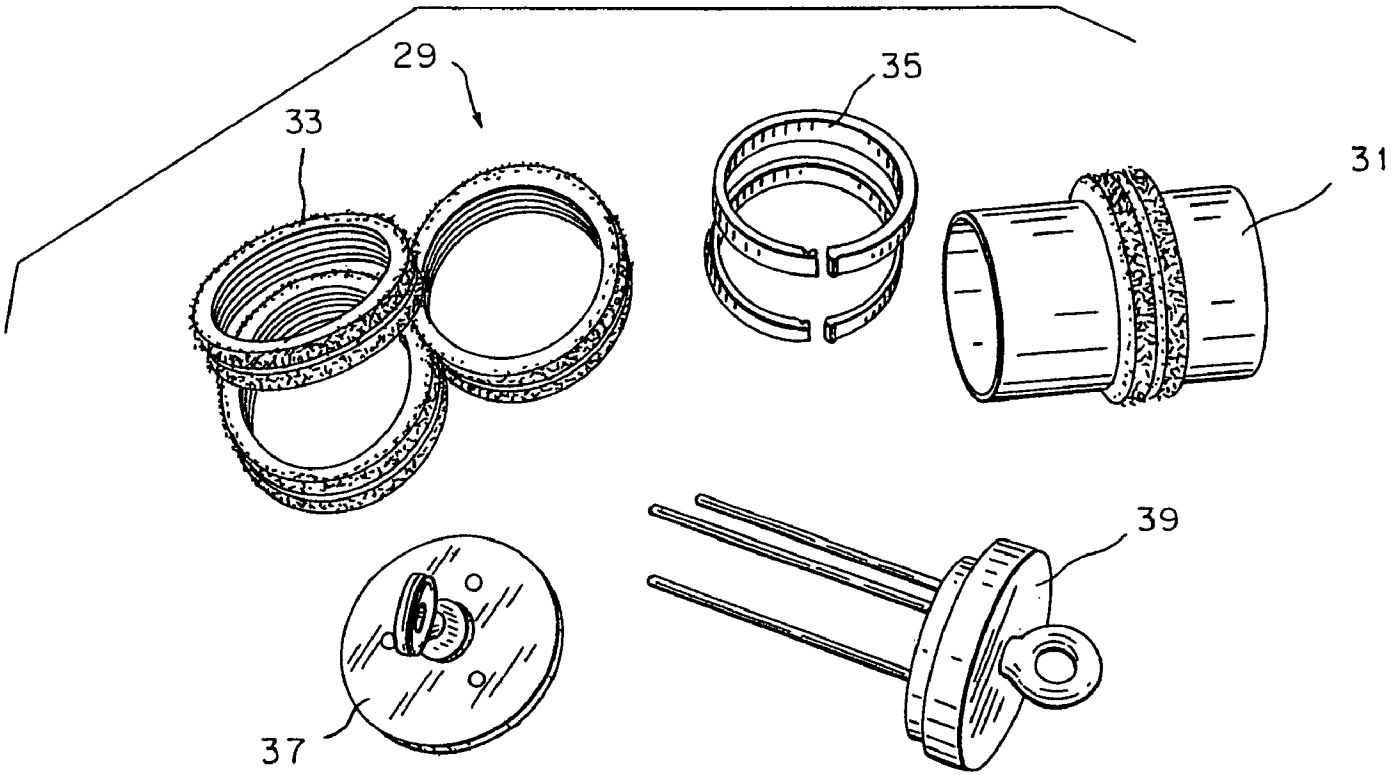
FIG. 3 is a cleaning brush assembly for use with the portable cannon tube cleaning system of the invention.

Referring to FIG. 3, a cleaning brush assembly 29 for use with the portable cannon tube cleaning system includes a main cleaning head 31, a plurality of spiral brushes 33 made of any of a variety of brush materials (e.g., nylon, horse hair, boar bristle, stainless steel), a plurality of locking rings 35 for holding the spiral brushes on the main cleaning head, and a front face mount 37 and a rear face mount 39 for mounting the main cleaning head. The cleaning brush assembly 29 is put together by locking the spiral brushes 33 on the main cleaning head 31 with the locking rings 35 and mounting the main cleaning head on the front and rear face mounts 37 and 39.

In operation, the trailer 3 is pulled by a motor vehicle to the site of the cannon tube to be cleaned. The vertical height of the main cleaner chassis assembly 17 is manually or automatically adjusted to be in line with the cannon tube to be cleaned by actuating the lifting platform 15. The main cleaner chassis assembly 17 is fitted against the face of the cannon tube, and the hollow adapter plate 19 is fitted on the outer diameter of the cannon tube. The free end of the winch cable 25 is dropped through the cannon tube and connected to the cleaning brush assembly 29. A solvent is applied to the cleaning brush assembly, and the winch controller 23 controls the winch to haul the cleaning brush assembly through the cannon tube for as many cycles as required to adequately clean the cannon tube for inspections.

It is obvious that many modifications and variations of the present invention are possible in light of the above teachings. It is therefore to be understood that within the scope of the appended claims, the invention may be practiced otherwise than as described.

What is claimed is as new and desired to be secured by Letters Patent of the United States is:

1. A portable cannon tube cleaning method comprising the steps of:

pulling a trailer to the site of a cannon tube to be cleaned;

adjusting the height of a main cleaner chassis assembly to be in line with the cannon tube to be cleaned;

fitting the main cleaner chassis assembly against a face of the cannon tube;

fitting a hollow adapter plate on the outer diameter of the cannon tube; and hauling a cleaning brush assembly through the cannon tube for as many cycles as required to adequately clean the tube for inspections.

2. The method recited in claim 1 wherein the height of the main cleaner chassis assembly is adjusted with a lifting platform.

3. The method recited in claim 1 wherein the cleaning assembly is hauled with a winch.

4. The method recited in claim 1 including the step of:

applying a solvent to the cleaning brush assembly.

* * * * *